US008678255B2

(12) United States Patent
Zhang et al.

(10) Patent No.: US 8,678,255 B2
(45) Date of Patent: Mar. 25, 2014

(54) PERSONAL PORTABLE DEVICE KEEPER

(76) Inventors: Zhengping Zhang, Alexandria, VA (US); Xiaohua Liang, Alexandira, VA (US); Liang Zhang, Alexandria, VA (US)

( * ) Notice: Subject to any disclaimer, the term of this patent is extended or adjusted under 35 U.S.C. 154(b) by 67 days.

(21) Appl. No.: 13/320,261

(22) PCT Filed: May 8, 2010

(86) PCT No.: PCT/IB2010/052038

§ 371 (c)(1), (2), (4) Date: Nov. 12, 2011

(87) PCT Pub. No.: WO2010/131177

PCT Pub. Date: Nov. 18, 2010

(65) Prior Publication Data

US 2012/0055965 A1 Mar. 8, 2012

Related U.S. Application Data

(60) Provisional application No. 61/177,651, filed on May 13, 2009.

(51) Int. Cl.
*B65H 75/40* (2006.01)
*A45F 5/00* (2006.01)

(52) U.S. Cl.
USPC ..... 224/162; 224/930; 24/3.13; 24/114.5; 24/129 R

(58) Field of Classification Search
USPC ..... 224/257, 929–930, 600, 162; 24/129 R, 24/114.5, 3.13, 130, 129 A
See application file for complete search history.

(56) References Cited

U.S. PATENT DOCUMENTS

| | | | | |
|---|---|---|---|---|
| 5,938,137 | A | 8/1999 | Poulson | |
| 6,019,304 | A | 2/2000 | Skowronski et al. | |
| 6,199,785 | B1 | 3/2001 | Paugh | |
| 6,290,158 | B1 | 9/2001 | Huang | |
| 6,419,175 | B1 | 7/2002 | Rankin | |
| 6,502,727 | B1 | 1/2003 | Decoteau | |
| 6,966,519 | B2 | 11/2005 | Salentine et al. | |
| 7,228,651 | B1 * | 6/2007 | Saari | 40/1.5 |
| 7,354,304 | B2 | 4/2008 | Livingston | |
| 7,364,109 | B2 | 4/2008 | Kuo | |
| 7,384,013 | B2 | 6/2008 | Yen | |
| 7,661,620 | B2 | 2/2010 | Fields | |
| 7,665,684 | B2 | 2/2010 | Salentine et al. | |
| 2005/0011982 | A1 | 1/2005 | Salentine et al. | |
| 2005/0072819 | A1 * | 4/2005 | Maldonado et al. | 224/162 |
| 2006/0042151 | A1 * | 3/2006 | Kavanaugh | 43/44.89 |

* cited by examiner

*Primary Examiner* — Justin Larson
*Assistant Examiner* — Scott McNurlen

(57) ABSTRACT

A personal portable devices keeper (10) and its method of use are disclosed. The keeper mainly comprises a housing formed by a shell (12) and a base (14), a spool assembly (16) controlled by a spiral spring (18) and a ratchet mechanism consisting of a ratchet plate (32) in the spool, a ratchet bead (20), and a straight slot (50) in the base, a clip (22), and a length of cord (24) with a bob (72) securing a strap loop (90). The shell has a cord port (28) and is rotatable independently from the spool so that the cord remainder is adjustable even after the cord is fully retracted by the spring. The strap loop ties a personal portable device directly through its strap holder or the like. The keeper is fully operable through the cord dragged by the portable device that is normally held and operated by one hand.

8 Claims, 2 Drawing Sheets

PERSONAL PORTABLE DEVICE KEEPER

TECHNICAL FIELD

This invention relates generally to security devices for personal portable electronic devices and particularly to the improvements of retractable cord reels for suitably securing personal portable electronic devices continually.

BACKGROUND ART

Personal portable electronic devices, such as cell phones, have become more popular, more important, more sophisticated, more expensive, and smaller than ever. Because of their small sizes, such devices are often lost or damaged by falling or dropping before their owners' awareness. To avoid such losses, the consumers usually pay extra for insurances or for protective accessories such as holsters or cases. However, the insurances are expensive over time and guarantee no immediate replacements by the insurance companies; the protective accessories are inconvenient and guarantee no protection for the portable devices while in use.

It is natural to apply retractable cord reels, which have been widely used for small personal items such as keys or ID badges, to securing cell phones, as disclosed in U.S. Pat. No. 5,938,137 to Poulson, U.S. Pat. No. 6,502,727 to Decoteau, and U.S. Pat. No. 7,354,304 to Livingston. One disadvantage of the retractable reels disclosed in these inventions is that their openings for exiting cord are fixed. Such feature is not suitable for cell phones, which are not only small in size but also often in use so that their position and height are frequently changed, upward and higher when in use but downward and lower when in a handbag or pocket. As a result, the cord is usually bent at the openings and thus less durable. Therefore, the retractable reels with a 360 degree-rotatable housing, as disclosed in U.S. Pat. No. 6,290,158 to Huang, U.S. Pat. No. 6,419,175 to Rankin, and U.S. Pat. No. 6,966,519 to Salentine et al., are useful for cell phones as disclosed in U.S. Pat. No. 7,665,684 to Salentine et al. and U.S. Pat. No. 7,661,620 to Fields.

One common disadvantage of all the retractable reels referenced above when used for cell phones is that if not directly tying cell phones, they cannot prevent the phones from dropping or losing but if tying the phones directly, while in use, they constantly pull the user's hand by the cord and disturb user's clothing in the cord's path, if any. Thus, the use of retractable cord reels with ratchet mechanisms, such as the one disclosed in U.S. Pat. No. 6,199,785 to Paugh, can overcome the disadvantage, as disclosed in U.S. App. Pub. No. 2005/0011982 by Salentine et al. Such retractable reels are lockable through certain mechanisms exerting some amount of force on the reels to prevent the cord from being retracted and therefore keep the cord relaxing when the cell phone is in use. However, the operation for unlocking the reels to retract is not coordinated with the normal operation of the cell phone and cannot be conveniently done by the hand holding the phone.

There are other kinds of ratchet mechanisms as disclosed for conductive or electronic cable reels in U.S. Pat. No. 6,019,304 to Skowronski et al., U.S. Pat. No. 7,364,109 to Kuo, and U.S. Pat. No. 7,384,013 to Yen, which are operable by pulling the cables. Such ratchet mechanisms can be integrated into retractable cord reels, so-called 'single-pull' reels, and be used for cell phones as disclosed in Chinese Pat. No. 02253321.4 to Kuo. Because their openings for exiting cord are also fixed in orientation, such retractable cord reels still have the same disadvantage as described above when applying to cell phones. To get around this, in Kuo's invention, the reel is loosely mounted to an object by a loop, a hook, or the like so that its position can vary easily with the cord around the mounting point. For the same token, however, the cord cannot be instantly retracted or pulled until whole system is adjusted and stretched against the mounting point. As a result, the retractable reel operates less smoothly for cell phones.

DISCLOSURE OF INVENTION

Technical Problem

So far, there are no retractable cord reels having both rotatable and ratchetable functions for lack of either simple ways to combine both or strong motivation to do so. However, it would be non-obvious to integrate the rotatable function into retractable cord reels with a 'single-pull' ratchet mechanism as such integration can protect a cell phone continually and, at the same time, enables the user to use the cell phone almost normally by one-hand. Accordingly, an object of the present invention is to produce the integration suitable for cell phones.

Furthermore, all the conventional retractable reels have a common feature that their cord remainder are predetermined and fixed in length, usually at about zero, after complete retraction. In the application of a conventional reel without a ratchet mechanism to a cell phone stored in a different location from where the reel is mounted, an additional device such as a lanyard or strap is needed. If a ratchetable reel is used instead, although a desired length of cord can be kept outside its housing by its ratchet, the cell phone will be pulled out of the storage if further retraction is adversely triggered. Because its ratchet makes the spiral spring constantly in greater tension, the reel would be less durable. Accordingly, another object of present invention is to improve retractable cord reels so that the cord remainder is easily adjustable in length and the users can secure or store their cell phones in different locations.

If one wants to use a conventional retractable cord reel to secure both a cell phone and an ID badge simultaneously at different locations, an additional strap or the like is necessary. Therefore, another object of the present invention is to provide a simple improvement on the retractable cord reels so that they can secure the both alone with no extra accessory.

Further objects and advantages of the present invention will become apparent after consideration of the following detailed descriptions and drawings.

SUMMARY OF THE INVENTION

This invention discloses a security device for personal portable devices, such as cell phones, that comprises an improved retractable cord reel. The improved reel is a conventional retractable cord reel that is integrated with both a single-pull ratchet mechanism and a rotatable cord opening, sleeve, or port so that a cell phone can be secured by the cord continually and be operable through the cord in close coordination with the manual operation of the cell phone by only one-hand. The user secure the cell phone by tying or fastening it with the cord and mounting the reel to an object, such as a belt, pants, or handbag, close to the location where the phone is held or stored. After the user pulls out the cell phone from its storage and stops to use it, the reel will adjust its port orientation to the cord direction, be locked automatically, and keep the cord relaxing; feeling no cord tension, the user can make calls normally. After use, the user pulls the cord slightly, then releases it, and puts the cell phone back to the storage. In the whole operation, the user only handles or holds the cell phone with one-hand and uses the phone as normally as it is not tied because of the ratchet mechanism. Furthermore, manually rotating the cord port, the user can easily adjust the cord remainder to a desirable length for storing the cell phone properly after the reel's complete retraction. After installing a cord buckle with a ring hole onto the remainder, the user can use such improved reel to secure both a cell phone and an ID badge simultaneously at separate locations.

BEST MODE

Figure 1A:
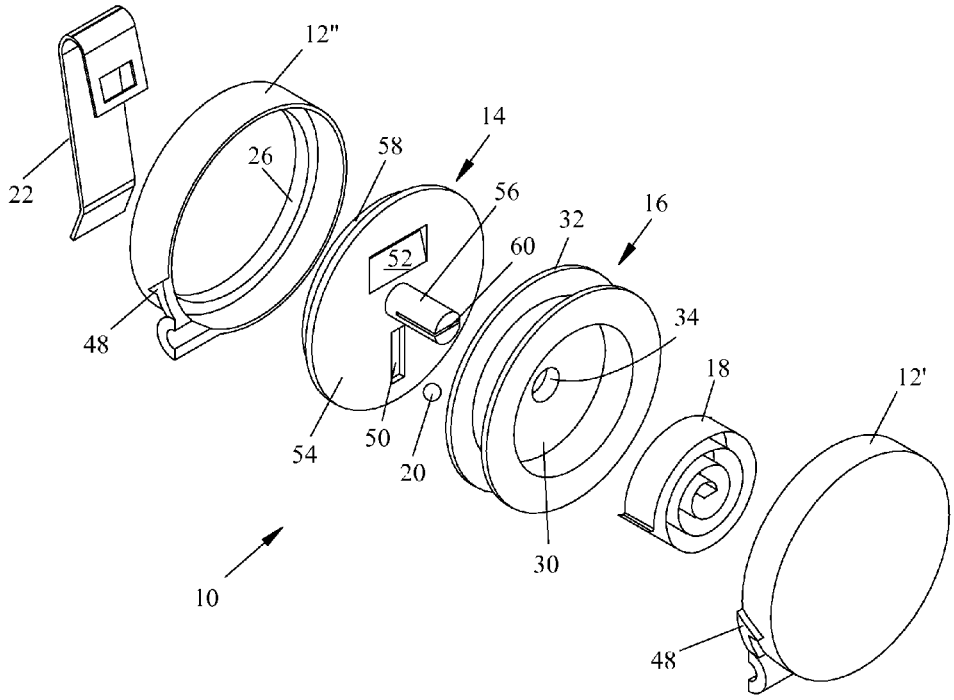
FIG. 1A is an exploded view of a preferred embodiment of the personal portable device keeper in accordance with the present invention.

A preferred embodiment of the present invention, a personal portable device keeper 10, is illustrated in FIGS. 1, 2. The keeper mainly comprises a housing formed by a cover or shell 12 and a base 14, a spool assembly 16 disposed in the housing, a spiral spring 18, a ratchet ball or bead 20, a clip 22, and a length of pulling cord 24. Cover 12 has an opening or a port 28 in its sidewall to allow cord 24 to exit the housing and consists of a front half 12' and a rear half 12", which are two substantially cylindrical one-end-opened shells and are fastened together at their rims. Half cover 12" has an axial, circular opening 26 through its close end. Port 28 extends along a line substantially tangent to the circular contour of cover 12.

Base 14 comprises a cylinder or disc 54 and a cylinder or disc 58, which are coaxially connected and have a slot 52 through both. Disc 54 is larger than disc 58 in diameter and has a straight channel or groove 50 and an axle or a spindle 56 that extends axially outward.

Figure 1B:
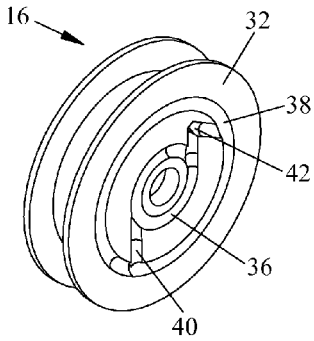
FIG. 1B is a perspective view of an embodiment of the ratchet plate of the spool in accordance with the present invention.

Spool assembly 16 is a conventional spool having a circular rim at each end and a central cylindrical cavity 30 which bottom is integrated with a ratchet plate 32. The ratchet plate has an axial circular through-hole 34 smaller than cavity 30 in diameter, an inner annular channel or groove 36, an outer annular channel or groove 38, a straight transfer-in channel or groove 40 from channel 38 to channel 36, and a V-shaped transfer-out channel or groove 42 from channel 36 to channel 38, as shown in FIG. 1B. Bead 20 is disposed and rolls continually in both channel 50 and one of channels 36-42 that are one-way for the bead so that it stops and moves relatively to the channels in a well-defined pattern, forming a ratchet mechanism, as known in the art.

Spindle 56 is sized to engage with through-hole 34 to support pivotally spool assembly 16 and has a slot 60. Disc 58 is seized to mate or engage with opening 26 so that it can support cover 12 pivotally.

Spring 18 is a spiral spring that is disposed in cavity 30 of spool assembly 16 and is mounted or secured to spindle 56 in slot 60 and the sidewall of cavity 30 in a slot (not shown) respectively at both ends. Spool assembly 16 is urged by spring 18 and is pivotally supported via spindle 56. An arrow 48 is marked on cover 12 and points to the direction in which spring 18 relaxes and cord 24 is wound.

Clip 22 is secured to base 14 at its one end snapping at a tab (not shown) in slot 52 and to an external object, such as a belt, pants, or handbag worn by the user, by its other end.

Cord 24, preferably made of clear, durable flexible material such as Nylon, is secured at one end to the spool and is disposed or wound around spool assembly 16, as well known in the art.

Figure 2A:
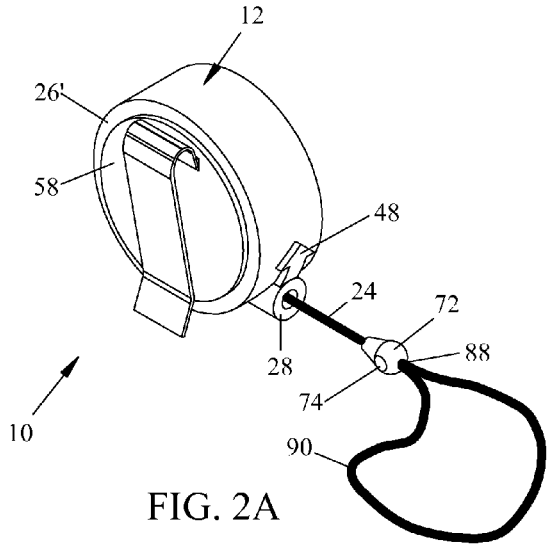
FIG. 2A is a perspective view of an embodiment of the personal portable device keeper having a cord remainder that is attached to a bob or knob with a through-hole for strap or ring in accordance with the present invention.
Figure 2B:
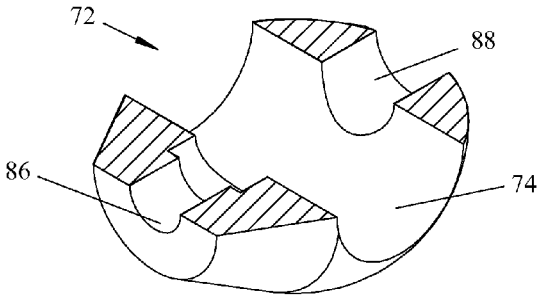
FIG. 2B is a sectional perspective view of an embodiment of a bob or knob in accordance with the present invention.

In FIG. 2A is illustrated that cord 24 extends out of the housing through port 28. The outer end of the cord is attached to a bob 72 having a through-hole 74 for strap or ring or the like, a through-hole 86 for cord, and a through-hole 88 for cord or strap, as shown in FIG. 2B. Holes 86, 88 are substantially coaxial and are perpendicular to the axis of hole 74 that is larger than holes 86, 88 in diameter. The cord is knotted at its outer end and secured through hole 86, as known in the art. Similarly, a length of strap is knotted at its ends to form a loop 90, installed through holes 74 and 88, and secured by the knot inside hole 74.

After being tied with loop 90 to a cell phone by its strap holder or other security means and mounted by clip 22 to an object worn by the user, keeper 10 can be operated by one hand in coordination with the phone's operation as follows. The user pulls the cell phone out of its storage such as a pocket or handbag, holds it moving up by a distance slightly longer than a desired length for cord 24, and then moves it to the ear while releasing the cord. In the process, keeper 10 adjusts the orientation of its port 28 through the cord pulling and locks the cord to the desired length automatically through its ratchet mechanism as soon as the cord relaxes. Actually when the cord relaxes, spool 16 urged by spring 18 reversely rotates so that bead 20 moves from channel 36 into V-shape channel 42 and stops there because any further relative movement to the spool in the same direction is prevented. As a result, spool 16 stops winding or retracting cord 24. Thus, feeling no cord dragging or pulling, the user can make calls normally. After calling, the user pulls the cord slightly and then releases it to allow its retraction while putting the cell phone back to the storage. Actually the slight pull moves bead 20 out of V-shape channel 42 and into channel 38 in which the bead can roll continually when the cord is released until spring 18 relaxes completely. In the whole process, while the cell phone is protected all the time, the user handles or holds the cell phone with one-hand as normally as if the phone had no protection.

When spring 18 is completely relaxed, manually rotating cover 12 or port 28 about spindle 56 in the direction illustrated by arrow 48, the user can easily extend the cord remainder, the length of the cord outside the port. This actually unwinds cord 24 off spool 16 without involvement of the spring. Conversely, rotating cover 12 or port 28 against the direction, the user can shorten the cord remainder as the cord is wound. Therefore, the user can easily adjust the cord remainder to a desirable length for storing the cell phone properly. Such adjustment can be accomplished either by hand or by pulling and dragging the cord.

Figure 3A:
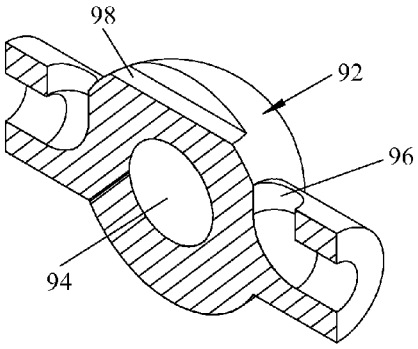
FIGS. 3A & 3B are sectional perspective views of two different embodiments of a cord buckle with ring hole in accordance with the present invention.
Figure 3B:
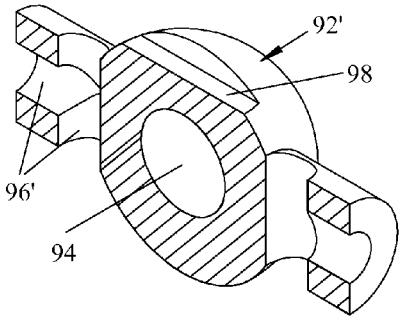
Figure 4:
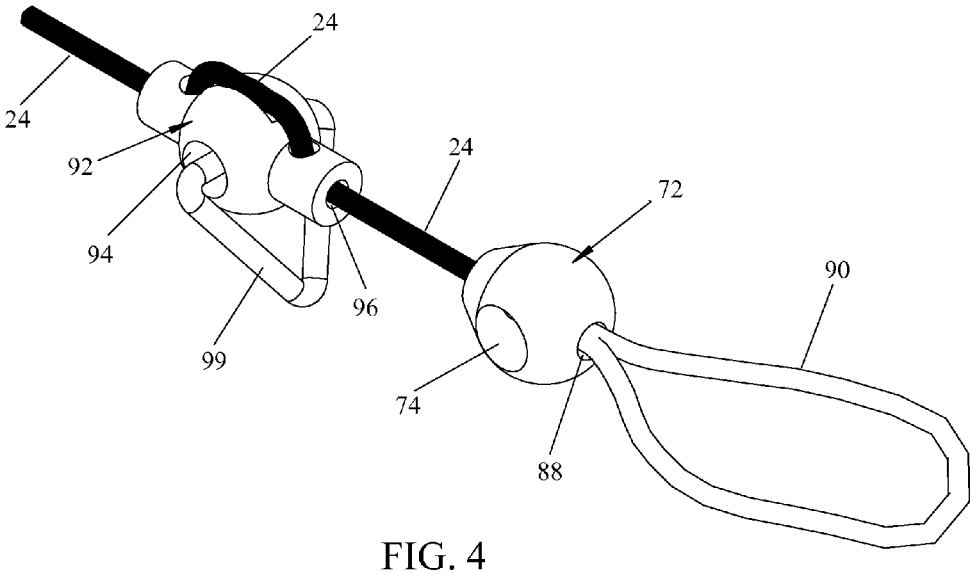
FIG. 4 is a perspective view of an embodiment of a cord remainder with a cord buckle and a bob or knob in accordance with the present invention.

The adjustability for the cord remainder can be further used to secure both a cell phone and an ID badge simultaneously at separate locations if a cord buckle 92 is installed onto the cord, as illustrated in FIGS. 3, 4. The buckle, preferably made of plastics, comprises a ball with two cylinders coaxially connected on its opposite poles. The ball is larger than the cylinders in diameter and has a central through-hole for ring 94, which axis is substantially perpendicular to the axis of the cylinders parallel to a straight slot 98. Each cylinder has a L-shaped through-hole 96 consisting of two connected holes that are substantially perpendicular to each other. Buckle 92 is installed onto cord 24, which passes through one hole 96 at one end, sets in slot 98, and then passes through another hole 96 at the other end. The buckle can be secured at any position along the cord in a manner similar to conventional strap buckles. A ring 99 is installed in hole 94 to secure or hold small personal items, such as an ID badge. There are different ways to make the cord buckle in accordance with the present invention. Another embodiment of the cord buckle, a buckle 92' with two T-shaped through-hole 96', is shown in FIG. 3B.

Another embodiment of the personal portable device keeper of the present invention that is identical to the preferred embodiment described above except with no ratchet mechanism can be also useful for securing small personal items that does not need to be held by hand constantly.

INDUSTRIAL APPLICABILITY

A number of advantages of the present invention, from the description above, are evident: it secures cell phones continually; it is operable with one-hand in a manner of handling cell phones; it enables the users to use cell phones normally while the phones are secured or protected; it is adjustable for simultaneously carrying, securing, holding, or storing both cell phones and other small items in a variety of simple ways; and it is useful for personal portable electronic devices in general.

While the above description contains a lot of specificity, this should not be construed as limitations on the scope of the invention, but as exemplifications of the presently preferred embodiment thereof. Many other ramifications and variations are possible within the teachings of the present invention. For example, the keeper may alternatively or additionally comprise the following: 1) different ratchet mechanisms operable through the cord by one-hand; 2) a cover partially rotatable with the port, instead of whole cover rotatable; 3) an additional means for mounting a strap holder or the like to portable electronic devices without a strap holder, such as a case or holster with a strap holder; 4) an alternative means for securing portable electronic devices, such as using a strap and ring mounted to the bob's hole for ring, instead of using the cord loop; and 5) an alternative means for mounting the keeper to an external object, such as buckle clips or lanyards.

Thus the scope of the invention should be determined not by the embodiments illustrated, but by the appended claims and their legal equivalents.

The invention claimed is:

1. A personal portable device keeper, comprising:

a housing formed by a base and a shell having an opening or a port, said base supporting pivotally said shell and having a spindle or an axle extending axially inside said housing, said spindle or axle supporting pivotally a spool with a central cavity, said spool being urged by a spiral spring disposed in said cavity, said spring being secured at both ends to said spindle or axle and said spool respectively, a length of cord being wound around said spool, said cord being secured at one end to said spool and exposed at the other end to said opening or port, and a secure means for securing or mounting said base to an external object, a ratchet means for controlling the rewind of said cord, said ratchet means being completely independent of said shell and fully operable through said cord by first pulling and then relaxing in such a way that, after relaxed, said cord is not rewound if pulled for a length longer than a first predetermined length but said cord is rewound if pulled for a length shorter than a second predetermined length and longer than a third predetermined length, and said first predetermined length being longer than said second predetermined length, whereby after tying or securing a portable electronic device with said exposed end, the user can operate said keeper with one-hand while handling or holding said portable electronic device.

2. The personal portable device keeper of claim 1, wherein said ratchet means includes a plurality of channels and a bead movable and disposed in said channels.

3. The personal portable device keeper of claim 1, further including:

a tie means for fastening said exposed end to said portable electronic device.

4. The personal portable device keeper of claim 1, further including:

a cord buckle having a through-hole for a ring and being movably mounted or secured on said cord, whereby, in addition to said portable electronic device, said user can adjust the length of said cord remainder and the position of said buckle and mount a small personal item with the ring, such as an ID badge, to said through-hole; as a result, said portable electronic device and said personal item are secured simultaneously at separate locations.

5. The personal portable device keeper of claim 2, wherein said secure means includes a clip.

6. The personal portable device keeper of claim 4, wherein said secure means includes a clip.

7. A personal portable device keeper, comprising:

a substantially cylindrical housing having a spindle axially extending internally and an opening or a port, a spool being disposed in said housing and supported pivotally by said spindle, said spool having a central cavity, a spiral or coil spring being disposed in said cavity and secured at both ends to said spindle and said spool respectively, a length of cord being secured at one end to said spool, wound around said spool, and exposed at the other end to said opening or port, said spool being urged by said spring and being rotatable about said spindle, said spool unwinding when the exposed end of said cord is pulled and rewinding when said cord is relaxed, a ratchet means for preventing said cord from being rewound, said ratchet means being independent of said shell and operable through said cord by such a pulling-then-releasing manner that, when released, said spool stops rewinding if said exposed end is pulled by a length longer than a first predetermined length but said spool rewinds if said exposed end is pulled by a length shorter than a second predetermined length and longer than a third predetermined length, said first predetermined length being longer than said second predetermined length, a secure means for securing or mounting said housing to an external object, said opening or port being rotatable with respect to said secure means, whereby after tying or securing a cell phone with strap holder by said exposed end, a user can operate said keeper with one-hand while handling or holding said cell phone.

8. The personal portable device keeper of claim 7, wherein said opening or port is rotatable independently of said spindle, whereby the cord remainder outside said opening or port is adjustable in length independently of said spool and spring by unwinding or winding said cord either directly by hand or indirectly by pulling and dragging said exposed end.

* * * * *